United States Patent [19]

Tobita et al.

[11] 3,974,467

[45] Aug. 10, 1976

[54] LONG FLEXIBLE WAVEGUIDE

[75] Inventors: Susumu Tobita, Ichihara; Masashi Shimoishizaka, Yokohama; Isamu Oishi, Yokohama; Keiichi Miwa, Yokohama; Hideo Kanda, Yokohama, all of Japan

[73] Assignee: The Furukawa Electric Co., Ltd., Tokyo, Japan

[22] Filed: May 29, 1975

[21] Appl. No.: 581,901

[30] Foreign Application Priority Data

July 30, 1974 Japan ..... 49-87353
July 30, 1974 Japan ..... 49-90926 [U]

[52] U.S. Cl. ..... 333/95 A; 333/98 R
[51] Int. Cl.$^2$ ..... H01P 3/14
[58] Field of Search ..... 333/95 R, 95 A, 98 R

[56] References Cited

UNITED STATES PATENTS 3,372,352 3/1968 Krank et al. ..... 333/95 A
3,444,487 5/1969 Krank et al. ..... 333/95 A

*Primary Examiner*—Paul L. Gensler
*Attorney, Agent, or Firm*—George B. Oujevolk

[57] ABSTRACT

A long flexible waveguide is fabricated by corrugating a thin-walled tube circular in section and then molding the corrugated tube so as to make the shape of its section substantially rectangular. The long flexible waveguide has a substantially rectangular section wherein a corrugating pitch P falls within a range of $\lambda_g/10<P<2K\sqrt{D \cdot t}$ where $\lambda_g$ denotes a wavelength in the waveguide, K a constant, D an outer diameter of the tube before the corrugation, and $t$ a thickness of the wall of said tube, and wherein a radius of curvature R of each inside corner of the molded tube falls within a range of $h \leqq R \leqq 0.46\ b$ where $h$ denotes a depth of the corrugate form of said tube, and $b$ a dimension of said tube on the side of a minor axis of said section. Rectangular waveguide thus fabricated has excellent electric characteristics and is produced under good working conditions.

3 Claims, 17 Drawing Figures

LONG FLEXIBLE WAVEGUIDE

BACKGROUND OF THE INVENTION

This invention relates to a long flexible waveguide having a substantially rectangular cross-section which is used as the transmission line of microwaves.

Waveguides for the transmission lines of microwaves have hitherto had various cross-section shapes such as circular, rectangular and as an ellipse. Further, long flexible waveguides which can be wound on a drum type winder have been often used to simplify the construction work and enhancing the reliability owing to the reduction of connection points. Those of the waveguides which are elliptical or approximately elliptical in section, are advantageous in that the workability is comparatively good and that electric characteristics are not spoiled even by a bending deformation arising when the waveguide is wound on the winder. Since, however, the rectangular waveguide is used on the feeder line side of a transmitter-receiver close to an input terminal and an antenna, the conversion ratio becomes large in case of matching the rectangular waveguide and the waveguide of the elliptic or approximately elliptic section. This leads to the disadvantage that the wide frequency band is damaged. Moreover, the elliptical or approximately elliptical waveguide exhibits a narrow fundamental mode band and has higher-order modes generated than the rectangular waveguide, so that the frequency band is restricted. Comparing an elliptic waveguide and a rectangular waveguide respectively illustrated in FIGS. 1(*a*) and 1(*b*), the frequencies at which higher-order modes are generated are made equal, the attenuation of rectangular waveguide is smaller in quantity as shown in FIG. 2. In the aspects of the electrical characteristics and the the rectangular waveguide is far more meritorious. The rectangular waveguide, however, involves problems such that corrugation in the rectangular state is very difficult and the electric characteristics are conspicuously damaged due to the bending deformation in the case of the windable long article.

One prior-art flexible rectangular waveguide has the corrugating pitch made small and the chamfering radius of each corner of the rectangle made as small as possible in order to match it with a rigid rectangular waveguide. In this case, a mandrel as an inner mold is required for forming a thin-walled pipe which is corrugated at the small pitch. Besides, even with the mandrel inserting system, a rectangular shape which is excellent in both workability and electric characteristics has not yet been discovered, and a desired precision in the case of a long article cannot be secured.

Where the H-bend is adopted in the bending job at the time of laying a prior-art long flexible waveguide, not only the flexural rigidity is high but also a problem to be explained below arises. FIGS. 8(*a*) and 8(*b*) are referred to in the explanation. In the prior-art, it is impossible to perform the H-bend with empty hands, and hence, an expedient of bending a waveguide 4' along a disc 3' as illustrated in FIG. 8(*a*) is used. Herein, a great thrust *c* is exerted on the side of the waveguide 4' by the disc 3' as a reaction component force of two forces in directions *a* and *b* are applied to the waveguide 4'. Although a force in the direction *c* also appears in case of the E-bend, it becomes very large in the case of the H-bend on account of the high flexural rigidity. Further, in actuality, the waveguide 4' is unbalanced and turns in a direction of arrow R as illustrated in FIG. 8(*b*). This renders it very difficult to smoothly execute the H-bend. The H-bend of the waveguide 4' along the disc 3' is therefore made smooth in such way that, as shown in FIGS. 9(*a*) and 9(*b*), the waveguide 4' is supported by a pair of upper and lower support means to 5' to check the turning. As previously stated, however, high flexural rigidity is involved in the H-bend. For this reason, a coating member 2' is pressed between a metal tube 1' and the disc 3' by the thrust in the direction of arrow *c* as applied from the disc 3' to the waveguide 4'. Since especially top areas of the crests of the corrugation have intense forces concentrically exerted thereon, the parts of the coating member 2' that correspond to the top areas undergo internal strains and become thin as illustrated in FIG. 10. Where, in this manner, the coating member 2' is thinned at the parts corresponding to the top areas of the crests of the corrugation, it deteriorates from the thin parts and gives rise to early cracks etc. under severe service conditions of wind and rain, intense heat, intense cold etc. When using the waveguide outdoors over a long time period. As a result, it loses its protective function for the metal tube 1' which is the principal constituent of the waveguide 4'.

Further, a prior-art long flexible waveguide which is corrugated in the form of a helix or bellows is not deformable by twisting. Another drawback is that, when it is twisted beyond a predetermined angle, the electrical characteristics are degraded at once. The reason for the degradation is believed to be that, since the structure which is difficult to be deformed is forcibly twisted, a part of the flexible waveguide yields to cause a buckling-like phenomenon, so a place indicated at A in FIG. 13 is locally distorted. (The distortion is exaggerated and shown in FIG. 13 in order to facilitate the understanding, but it is in actuality difficult to be examined with the naked eye. When the local distortion is to the extent that it can be seen with the naked eye, the flexible waveguide is quite inferior in the electric characteristics and cannot be used.)

SUMMARY OF THE INVENTION

This invention has for its object to provide a waveguide of the specified type which is excellent in the wide frequency band, the attenuation characteristic and the workability and which can be easily matched with a rigid rectangular waveguide.

Another object of this invention is to provide a long flexible waveguide in which top areas of the crests of a corrugate form of a metal tube constituting the waveguide are made flatter than in the original form thereof, to prevent the deformation of a coating member in the direction of its thickness from occurring due to an internal strain of the coating member as arises at the bending of the metal tube, whereby the endurance of the waveguide is ensured in using it under natural conditions attended with wind, rain, hotness and coldness.

Still another object of this invention is to provide a long flexible waveguide in which a strip having a high tensile strength is buried in a corrosion protective layer in order that a local torsion of the waveguide in the job of twisting the waveguide when it is laid may be made less prone to appear.

BRIEF DESCRIPTION OF THE DRAWING

FIG. 13 is a perspective view for explaining the twisted state of a prior-art flexible waveguide, while

DETAILED DESCRIPTION OF THE INVENTION

Figure 1A:
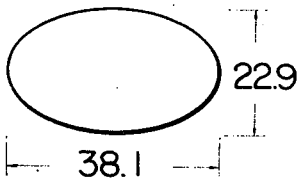
FIGS. 1(*a*) and 1(*b*) are diagrams showing the sectional shapes of an elliptical waveguide and a rectangular waveguide, respectively.
Figure 1B:
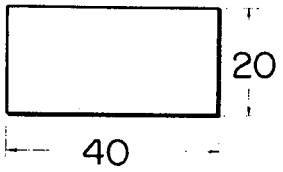
Figure 2:
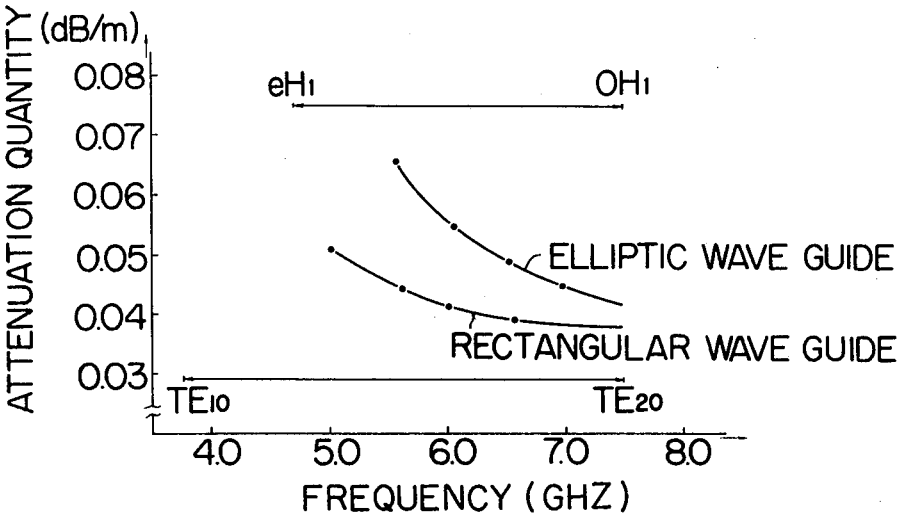
FIG. 2 is a graph for comparing the attenuation quantities of the two waveguides.

This invention shows measures to remedy the various problems hereinbefore stated. The first measure consists in skillfully setting the rectangular shape of the waveguide and thus making it excellent in both the workability and the electric characteristics. Hereunder the construction will be described with reference to the drawing showing an embodiment.

Figure 3:
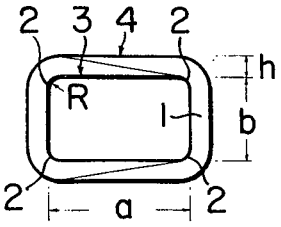
FIG. 3 is a sectional view showing the rectangular form of a waveguide according to this invention.
Figure 4:
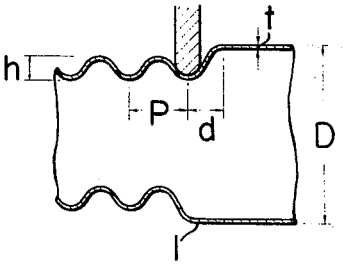
FIG. 4 is a sectional view showing the corrugate form of the waveguide in FIG. 3.

In FIGS. 3 and 4, numeral 1 designates a long flexible waveguide which is obtained by corrugating a thin-walled tube circular in section and then molding the thin-walled corrugated tube so as to make the shape of its section substantially rectangular. The waveguide 1 has substantially rectangular corrugated portions 3 and 4 formed under conditions that, letting $\lambda_g$ denote the wavelength in the waveguide, P denote the corrugating pitch, K denote a constant, D denote the outer diameter of the tube 1 before the corrugation and $t$ denote the thickness of the tube 1, the corrugating pitch P falls within a range of $\lambda_g/10<P<2\ K\sqrt{D\cdot t}$ and that, letting $h$ denote the depth of the corrugate form of the tube 1, R denote the radius of curvature of each inside corner 2 of the tube 1 and $b$ denote the dimension of the tube 1 on the side of a minor axis of the section, the radius of curvature R falls within a range of $h \leqq R \leqq 0.46\ b$.

Figure 8A:
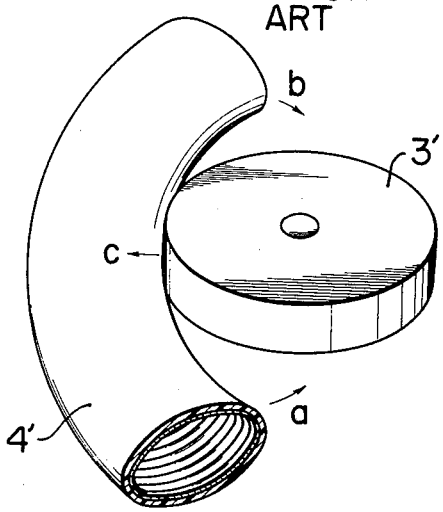
FIG. 8a PRIOR ART
FIGS. 8 and 9 are perspective views showing the states of the bend working of a prior-art waveguide.
Figure 8B:
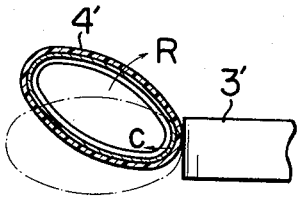
FIG. 8b. PRIOR ART
Figure 9A:
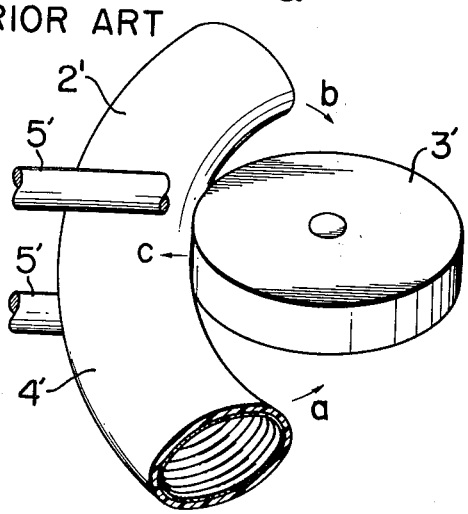
FIG. 9a PRIOR ART
Figure 9B:
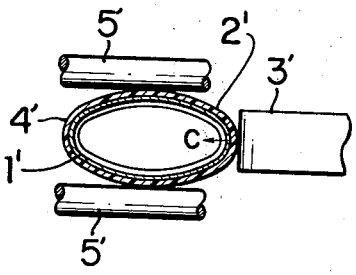
FIG. 9b. PRIOR ART
Figure 10:
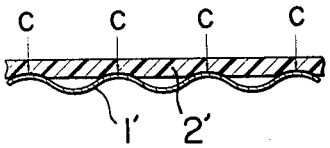
FIG.10 PRIOR ART
FIG. 10 is an enlarged sectional view of a part of the waveguide after the bend working.
Figure 11:
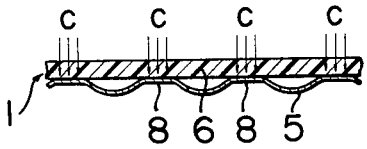
FIG. 11 is an enlarged sectional view of a part of a waveguide according to this invention, showing an embodiment of a metal tube for the waveguide.
Figure 12:
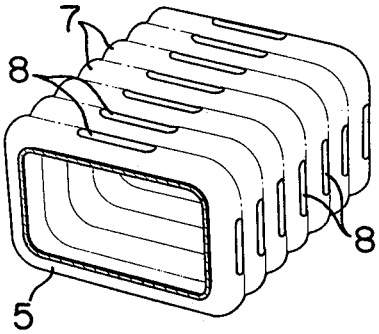
FIG. 12 is a perspective view showing another embodiment of the metal tube for the waveguide according to this invention.
Figure 13:
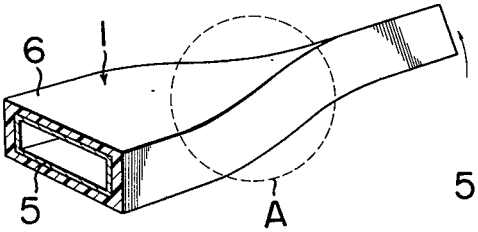
FIG.13 PRIOR ART

The second measure improves the property of the long flexible waveguide on the bending. In an embodiment shown in FIG. 11, top areas 8 of the crests of the corrugation of a metal tube 5 are formed into surfaces of a small curvature or flat surfaces. Thus, in executing the bend working such as H-bend and E-bend, the loads on the top areas 8 are dispersed to relieve the generation of the internal strains of a coating member 6 at the corresponding parts to the utmost. Another embodiment having a rectangular section as shown in FIG. 12 does not give rise to the turning in the direction of arrow R as indicated in FIG. 8(*b*), and is a long flexible waveguide which is very convenient in the practical use.

Figure 14:
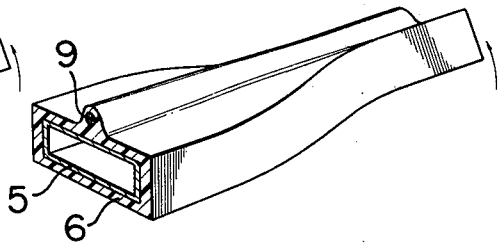
FIG. 14 is a perspective view of the twisted state of a waveguide according to this invention.

The third measure improves the property on the twisting. Referring to FIG. 14, a metal tube 5 which is corrugated in the form of a helix or bellows is formed on its outer periphery with a corrosion protective layer 6, in which a strip 9 having a high tensile strength is disposed along the longitudinal direction of the metal tube 5. Thus, even when the waveguide is twisted as illustrated in the figure, it can be smoothly twisted without the local buckling as appears in the prior-art waveguide of this type.

The essential points of this invention will be described more in detail. In general, the corrugation working of waveguides is conducted in order to bestow flexibility on thin-walled tubes subjected to the longitudinal butt weld. In case of fabricating a long waveguide, it is favorable that the corrugation working can be executed merely by applying a force from the outside. For this reason, it is a common practice to employ a ring-shaped jig which circumscribes the thin-walled tube. In this case, in order to work the tube to be uniform in the inner diameter, the outer peripheral wall of the tube may merely be pushed against the inner periphery of the ring-shaped jig in the radial direction thereof. Thus, the tube at a high accuracy of finishing is acquired. The corrugate form obtainable by such method, however, is subject to limitation. In FIG. 4, a deformation range $d$ of the working is hardly dependent upon the depth $h$ of the wave and is approximately expressed by the following equation:

$$d = K\sqrt{D\cdot t}$$

where $K$ represents the constant, $D$ the outer diameter of the tube of $t$ the thickness of the tube. The constant $K$ takes a value of 1 to 1.5, and is determined by the material of the tube.

Accordingly, when the corrugating pitch is made small under such state, the outer diameter of the corrugated tube diminishes. This results in work-hardening the crests of the corrugate form, and is effective to lessen the deformation of the crests of the corrugate form as occurs at a molding step to be stated later. The upper limit of the corrugating pitches at which the effect is achieved is $2\ K\sqrt{D\cdot t}$.

As the corrugating pitch is smaller, the voltage reflection characteristic is better. However, when the pitch is excessively small, also the depth of the corrugate form becomes small, and the retention of the electric characteristics against the bending becomes rather inferior. Therefore, in consideration of the bending radius which is required for the construction work and for the handling such s the winding of the waveguide round the winder, the lower limit of the corrugating pitch is about $\lambda_g/10$ where $\lambda_g$ denotes the guide wavelength.

In consequence, the corrugating pitch P which satisfies $\lambda_g/10<P<2\ K\sqrt{D\cdot t}$ induces the work hardening in the crests of the corrugate form and also keeps the bendability good.

The corrugating pitch P has been determined as explained above. Where the corrugated thin-walled tube which has the pitch P lying within the range of $\lambda_g/10<P<2\ K\sqrt{D\cdot t}$ and which is circular in section is molded by introducing it into a metal mold whose inlet is circular and whose outlet is substantially rectangular, an ideal rectangular shape cannot be attained due to the circular section of the tube before the molding, and it is necessary to appropriately determine the radius of curvature R of the inside corner 2 of the tube as indicated in FIG. 3. For best electric purposes the radius of curvature R should have the smallest possible value. However, when it is too small, a force required for the molding increases. Moreover, the dimensional accuracy is lowered so that the product cannot be used as the waveguide.

Figure 5:
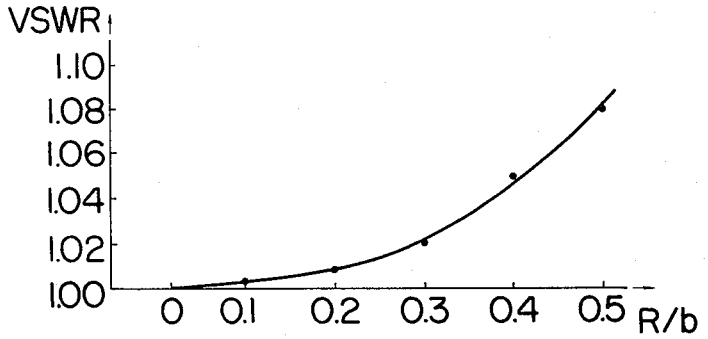
FIG. 5 is a graph showing the relationship between the radius of curvature of each inside corner of the rectangle and the voltage reflection characteristic.
Figure 6:
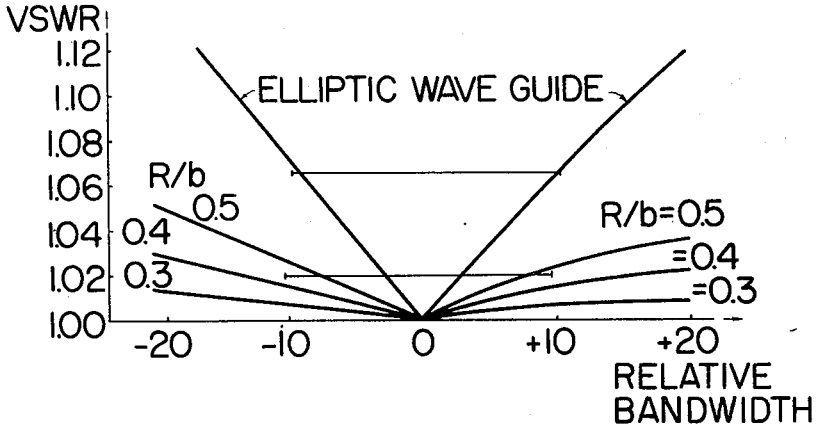
FIG. 6 is a graph showing the relationship between the relative band and the voltage reflection characteristic.
Figure 7:
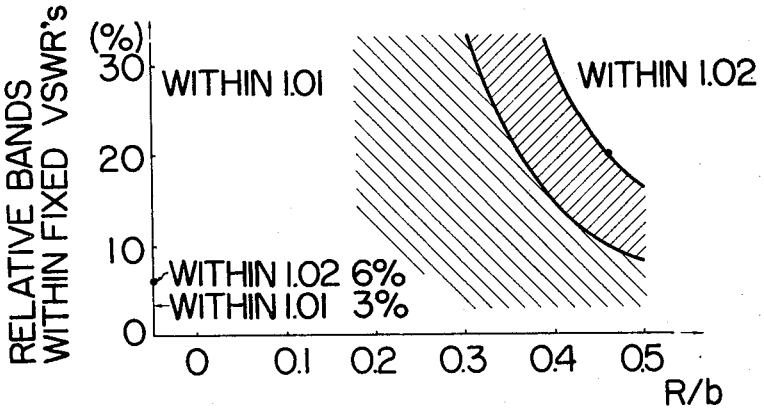
FIG. 7 is a graph showing the relationship between the radius of curvature of each inside corner of the rectangle and the relative band.

It is accordingly the limit for the production of the waveguide that the minimum value of the radius of curvature R becomes equal to the depth $h$ of the corrugate form as arises at the corrugation at which the corrugating pitch P is set within the range of $\lambda_g/10<P<2\ K\ \sqrt{D \cdot t}$. In this way, the minimum value of the radius of curvature R is determined. On the other hand, when the value of the radius of curvature R increases, the impedance of the flexible waveguide increases, and the voltage reflection characteristic of the flexible waveguide in the case of the connection with the rigid rectangular waveguide becomes inferior as illustrated in FIG. 5. In order to match the different impedances, a transformer is employed. As the transformer, a quarter-wavelength one-stage transformer which is structurally simple is meritorious because of ease in the design and fabrication. In the case where it is necessary to establish matching with the transformer, the mentioned transformer is therefore used, and thus, a waveguide transformation portion having stable characteristics can be produced inexpensively. Experiments have revealed that the relationship between the relative band and the voltage reflection characteristic (voltage standing wave ratio) in the case of establishing the matching by the use of the quarter-wavelength one-stage transformer while varying the value of the radius of curvature R is as shown in FIGS. 6 and 7. From these results, as values which can meet characteristics required for the feeder line of microwaves, the relative band need be set at 20% and the voltage standing wave ratio at 1.02 in order that they may become equivalent to those of the rigid rectangular waveguide. At this time, a value obtained by dividing the value of the radius of curvature by the minor axis side dimension $b$ is 0.46 at the maximum. The maximum value of the radius of curvature is therefore determined by multiplying the minor axis side dimension $b$ by 0.46. After all, the radius of curvature R can be determined to lie within the range of $h \leqq R \leqq 0.46\ b$.

Description will now be made of an example based on concrete numerical values. When $\lambda_g \doteqdot 64$ mm, $K \doteqdot 1.3$, $D = 42$ mm and $t = 0.5$ mm in a long flexible waveguide for 6 GHz (made of copper), the corrugating pitch P falls within a range of $6.4 < P < 11.9$. When the corrugating pitch is set at $P = 8$ mm, the depth of the corrugate form becomes $h = 2.5$ to 3.0 mm. When the dimension of the section on the side of the minor axis is set at $b = 20$ mm, the radius of curvature becomes $R = 9.2$ mm in conformity with $R/b = 0.46$. Consequently, the radius of curvature falls within $2.5 \leqq R \leqq 9.2$.

As the voltage reflection characteristic (VSWR) at the time when the relative band width is set at 20% as indicated in FIG. 6, a value of 1.065 is exhibited by an elliptic waveguide, whereas a value of 1.02 is exhibited by the long flexible waveguide of the substantially rectangular section explained above ($R/b = 0.46$). In actuality, irregularities ascribable to the corrugation job and the molding job are added to this value, and the final voltage reflection characteristic is still worse. The quantity of voltage reflection arising in the transformer portion needs to be reduced to the utmost. Referring to FIG. 7 in this respect, when the quantity of voltage reflection is made 1.02, the relative band becomes 6% in the elliptic waveguide, whereas it becomes 20% in the substantially rectangular waveguide of $R/b = 0.46$.

As thus far described, in producing a long flexible waveguide by corrugating a thin-walled tube subjected to the longitudinal butt weld and then molding the corrugated tube into a substantially rectangular section, this invention sets within a range of $\lambda_g/10 < P < 2\ K\ \sqrt{D \cdot t}$ the corrugating pitch P for keeping the uniformity required for the waveguide, to make the tube diameter after the corrugation smaller than that before the corrugation and also to work-harden the crests of the corrugate form. Further, where the tube of a circular section as thus corrugated is molded in a metal mold whose inlet is circular and whose outlet is substantially rectangular, this invention sets the radius of curvature R of each inside corner of the rectangle at $h \leqq R \leqq 0.46\ b$ in order to keep the uniformity and good electric characteristics as required for the waveguide. The following features and advantages are therefore achieved:

1. A flexible waveguide of wide band which is readily matched with a rigid rectangular waveguide is simply produced.

2. A waveguide which is smaller in the attenuation quantity than a waveguide having an elliptic section is produced.

3. Since the waveguide of wide band is acquired, the sorts of manufacturing plants can be made smaller than in case of the elliptic waveguide.

4. Since the corrugating pitch is set at the value at which the crests of the corrugate form are work-hardened, the molding into a substantially rectangular section attended with the work hardening effect as has hitherto been impossible can be realized at an accuracy required for the waveguide.

5. A transformer for matching the flexible waveguide with the rigid rectangular waveguide is simple in structure and low in cost.

As set forth herein, this invention can provide a long flexible waveguide substantially rectangular in section which has the various features and advantages.

We claim:

1. In a long flexible waveguide which is fabricated by corrugating a thin-walled tube being circular in section and subjected to the longitudinal butt weld and then molding the thin-walled corrugated tube so as to make the shape of its section substantially rectangular, a long flexible waveguide having a substantially rectangular section comprising the fact that a corrugating pitch P falls within a range of $\lambda_g/10 < P < 2\ K\ \sqrt{D \cdot t}$ where $\lambda_g$ denotes a wavelength in said waveguide, K a constant, D an outer diameter of said tube before the corrugation, and $t$ a thickness of the wall of said tube, and that a radius of curvature R of each inside corner of the molded tube falls within a range of $h \leqq R \leqq 0.46\ b$ where $h$ denotes a depth of the corrugate form of said tube, and $b$ a dimension of said tube on the side of a minor axis of said section.

2. The long flexible waveguide according to claim 1, wherein top areas of crests of said corrugate form are flattened on at least one of the sides of a major axis and said minor axis of said section of the metal tube, and an outer periphery of said metal tube is covered with a coating member as made of plastics.

3. The long flexible waveguide according to claim 1, wherein a corrosion protective layer is formed at an outer periphery of the metal tube, and a strip having a high tensile strength is buried in said layer substantially in parallel with an axis of said metal tube.

* * * * *